US008381911B2

(12) United States Patent
Buchner et al.

(10) Patent No.: US 8,381,911 B2
(45) Date of Patent: Feb. 26, 2013

(54) WEEKLY DISPENSER FOR MEDICAMENTS

(75) Inventors: Karl-Heinz Buchner, Annaberg-Buchholz (DE); Bertram Fritzsch, Annaberg-Buchholz (DE); Karin Berghauser, Annaberg-Buchholz (DE); Andreas Schuster, Annaberg-Buchholz (DE)

(73) Assignees: Karl-Heinz Buchner, Annaberg-Buchholz (DE); Bertram Fritzsch, Annaberg-Buchholz (DE)

( * ) Notice: Subject to any disclaimer, the term of this patent is extended or adjusted under 35 U.S.C. 154(b) by 0 days.

(21) Appl. No.: 12/675,230

(22) PCT Filed: Aug. 13, 2008

(86) PCT No.: PCT/DE2008/001349

§ 371 (c)(1), (2), (4) Date: Feb. 8, 2011

(87) PCT Pub. No.: WO2009/026886

PCT Pub. Date: Mar. 5, 2009

(65) Prior Publication Data

US 2011/0120905 A1 May 26, 2011

(30) Foreign Application Priority Data

Aug. 25, 2007 (DE) ..... 10 2007 041 924

(51) Int. Cl.
*B65D 83/04* (2006.01)

(52) U.S. Cl. ..... 206/538; 206/530

(58) Field of Classification Search ..... 206/539, 206/825, 528, 530, 534.1, 534.2, 538, 533, 206/540; 220/23.8, 826, 222, 523, 524, 553, 220/554

See application file for complete search history.

(56) References Cited

U.S. PATENT DOCUMENTS
(Continued)

FOREIGN PATENT DOCUMENTS

| | | |
|---|---|---|
| DE | 199 11 995 A1 | 3/1999 |
| EP | 438987 | 12/1926 |

(Continued)

OTHER PUBLICATIONS

Japanese office action of Appln. No. 2010-521297 dated Dec. 4, 2012.

*Primary Examiner* — Jacob K Ackun
*Assistant Examiner* — Jenine Pagan
(74) *Attorney, Agent, or Firm* — Antonelli, Terry, Stout & Kraus, LLP.

(57) ABSTRACT

Disclosed is a storage device for medicaments, comprising a rectangular bottom part with 7 compartments (1) that are separated by partitions (2) and each have an independent pivotable lid (3) such that each compartment (1) can be individually accessed. Seven compartments (1) have a same-sized rectangular horizontal section within the bottom part (4) of the weekly dispenser, while at least one longitudinal side (4.2) of the bottom part (4), more specifically the access side, has a convex wall (4.3), and the top edge (2.3) of all partitions (2) has a uniform curvature having a radius R in the longitudinal direction thereof. The 7 dimensionally stable and elastic lids (3) have an adapted curvature R' that matches said uniform curvature of the top edge (2.3) of the partitions (2). The closing parts (6) start detaching from one another when pressure is applied to the central or rear region of an arched elastic lid (3).

9 Claims, 5 Drawing Sheets

U.S. PATENT DOCUMENTS

Figure 1:
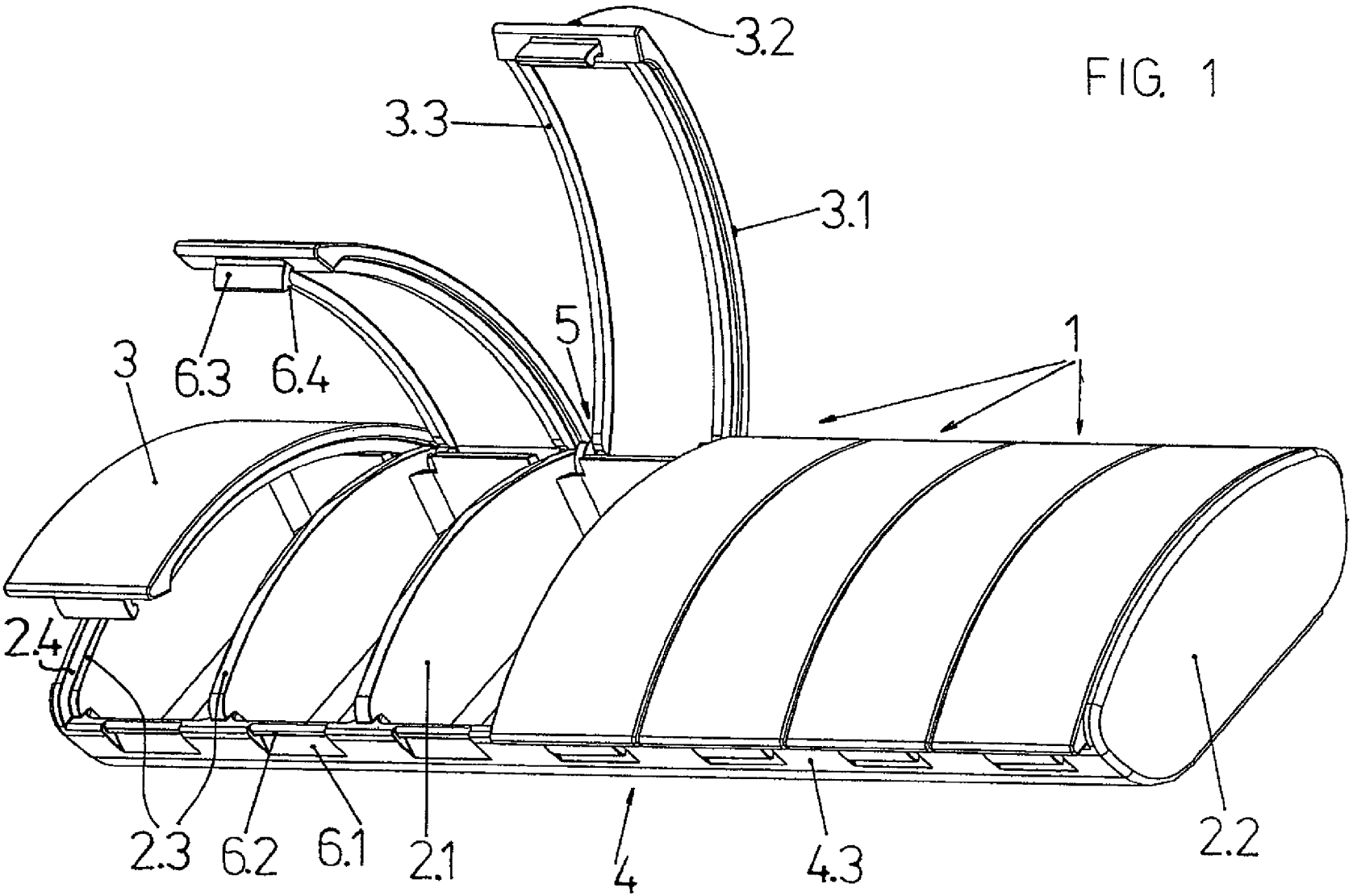

| | | | | | |
|---|---|---|---|---|---|
| 5,042,472 | A | * | 8/1991 | Bunin | 128/203.15 |
| 5,082,114 | A | | 1/1992 | Bunin | |
| 5,927,535 | A | | 7/1999 | Goth | |
| D466,801 | S | * | 12/2002 | Holland | D3/203.3 |
| D528,782 | S | * | 9/2006 | Oas | D3/203.3 |
| D587,898 | S | * | 3/2009 | Cetera | D3/203.2 |
| 2003/0038053 | A1 | | 2/2003 | Bramen | |
| 2003/0205496 | A1 | | 11/2003 | Howard et al. | |
| 2004/0089581 | A1 | | 5/2004 | Dienst | |
| 2005/0269237 | A1 | * | 12/2005 | Tung et al. | 206/534 |
| 2007/0062964 | A1 | | 3/2007 | Kampf et al. | |
| 2007/0138048 | A1 | * | 6/2007 | Coe et al. | 206/528 |

FOREIGN PATENT DOCUMENTS

| | | | |
|---|---|---|---|
| JP | 52-5805 | | 1/1977 |
| JP | 60-184542 | U | 12/1985 |
| JP | 05-212091 | A | 8/1993 |
| JP | 3105941 | U | 12/2004 |

* cited by examiner

FIG. 2.1
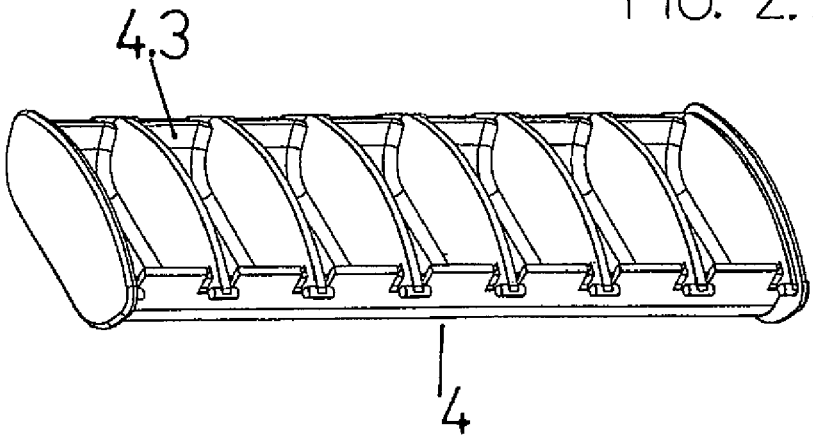
FIG. 2.3
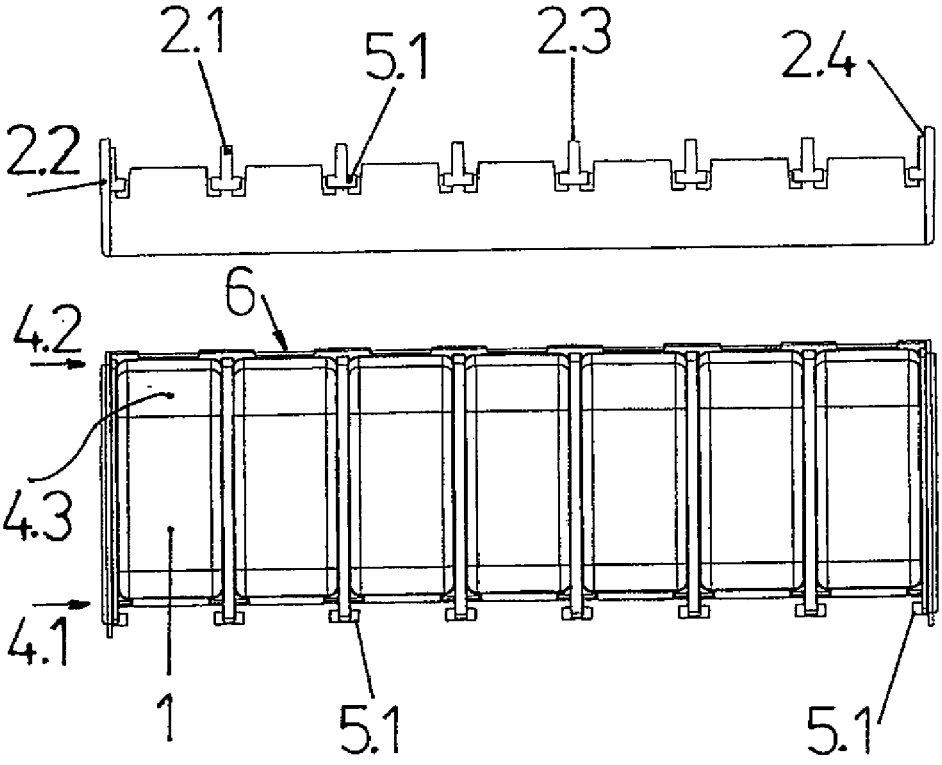
FIG. 2.2

FIG. 3.1
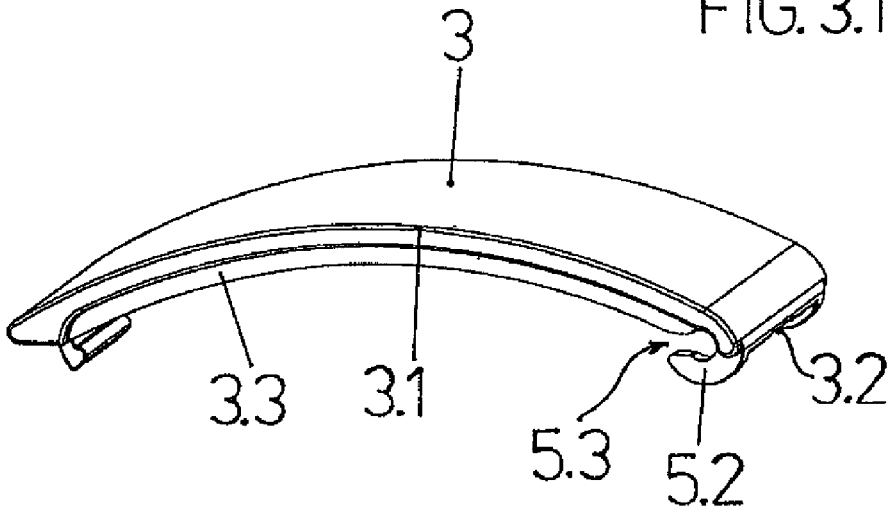
FIG. 3.2
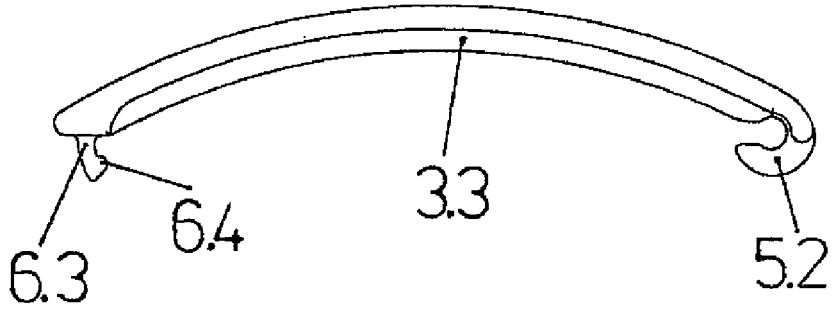
FIG. 3.3
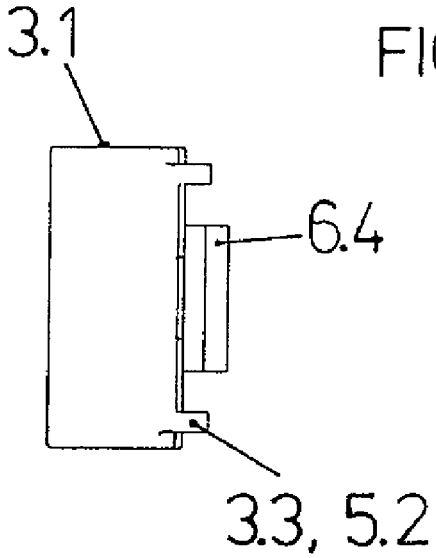

WEEKLY DISPENSER FOR MEDICAMENTS

The invention relates to a storage device for medicaments according to the generic part of claim 1, which is suitable to pre-sort and provide particularly solid pharmaceutical forms—adjusted to the medically prescribed individual intake rhythm of the respective patient—in daily doses such that the administration may be carried out without any problems at the proper dosage on the 7 days of the week.

Weekly dispensers are a reliable aid for all patients taking pharmaceuticals on a regular basis.

Utilizing 7 compartments the weekly dispenser is well organized and therefore easy to use.

All parts of the weekly dispenser are comprised of plastic.

A lockable sorting container is known from DE 199 11 995 C2, which has a flat cuboid shape comprising a plane bottom and lid surface.

A supplemental element that can be inserted into a cup-shaped housing is provided for the construction of the sorting container, which is comprised of a plurality of compartments disposed next to each other in longitudinal direction. Each individual compartment has a low width (B) and a width (A) exceeding the low width (B), and the compartments are associated with each other such that one compartment is disposed at the low width (B) thereof next to the compartment having the width (A) exceeding the low width (B). Finally, each compartment has a separate lid element that is independent of the other compartments, wherein the lid elements are each articulated on the side of the compartments having a low width (B). Film hinges are provided for the movable connection of the lid elements to the supplemental element.

A disadvantage of this weekly dispenser is the confusing design and arrangement of the compartments and lids having the alternating opening directions. Another disadvantage is further the double-wall construction of the bottom part.

Deriving from prior art the object of the invention is to develop a new weekly dispenser that avoids the disadvantages of prior art, e.g. that facilitates easy handling while having a simple and well organized construction.

A solution to this problem according to the invention is stated in claim 1. Further improvements of the invention are characterized in the sub-claims.

According to the design of the invention the rectangular and flat bottom part of the weekly dispenser 7 has same-sized compartments, which are divided by means of partitions, and which can be closed by means of separate lids having a uniform curvature.

The weekly dispenser is limited on both front sides by means of front walls.

The upper edge of all partitions has a uniform bend in the longitudinal extension thereof; the radius R is preferably about 45 to 55 mm.

At least one longitudinal side of the bottom part, more specifically the access side, has a wall that is arched toward the exterior, by means of which access to tablets or the like is facilitated in the compartments.

The 7 lids, which cover and close the 7 compartments, are dimensionally stable and elastic. The same have an adjusted curvature R', wherein the longitudinal edges of the lids extending parallel to the partitions each overlap up to about half of the internal partitions without the lids contacting each other in the closed state, or rest on the internal partitions.

The two front walls extend up to about the height of and along the exterior contour of the curved lids.

The same have an offset on the interior, which reaches up to the height of the interior walls, has about half of the thickness of the interior walls and the same curvature.

In order to attach and lock the seven movable lids the associated hinge parts and locking parts are disposed both on the narrow lateral edges of the lids and on the, or along the two longitudinal sides of the bottom part in the region of the 7 compartments.

The hinge parts A positioned on the one longitudinal side of the bottom part outside of the compartments each consist of two horizontal pins disposed in an intended straight parallel to the longitudinal side of the bottom part, which engage in pairs, e.g. on both sides of the internal partitions extended in the upper region of the partitions beyond the compartments, and individually at the projecting interior sides of both front walls of the bottom part.

The closing points C positioned on the other longitudinal side of the bottom part are integrated in the center in the upper edge region of the compartments as recesses having a latching lip positioned on the top, and inserted from the exterior.

The 7 lids curved at the radius R' have a rectangular cross-section in the projected base area thereof, and comprise the complementary hinge parts B and the locking parts D.

In a first embodiment the hinge parts B are comprised of two claws per lid, which are integrally molded onto the narrow side of the lid edge, at the lateral edge of the lid. Said claws are positioned at a distance from the longitudinal edges of the lid of about half of the thickness of the internal partitions, and comprise the related pins of the hinge parts A at a circumferential angle of greater than 180°, preferably of about 200 . . . 220°.

A rib reinforcement having a consistent cross-section that is quasi interrupted for configuring the claw opening and at the same thickness of the claws extends as an extension on the bottom side and parallel to the longitudinal edge of the lids.

For this purpose the end of the rib reinforcement on the claw side forms the inner side of the claw opening facing the lid bottom.

In order for the lids remaining seated on the pins in a permanent manner, the claw has a pin diameter, and the claw opening further has a sector angle of about 140 to 160°. By means of this sector angle positioned below the semi-circle a certain resistance on the pins must be overcome during the sliding open of the lid claws at the bottom part.

Although in a second embodiment of the hinge part B the rib reinforcement also comprises a consistent width, the depth thereof, however, is expanded in the hinge region such that the necessary configuration of the claw and of the claw opening may be carried out at a sector angle of about 140 to 160° for sliding open the respective associated pin of the hinge part A.

Analogously to the first exemplary embodiment, when sliding open the hinge part B onto the hinge part A, a certain resistance must also be overcome.

The complementary locking parts D are disposed on the side of the lids opposite of the hinge parts B.

The same are comprised of a latching bar having a latching lip provided on the bar end and positioned in the interior, which glides across the complementary latching lip, for example, during the closing action, and engages into the recess.

One intended effect achieved by means of the novel construction embodiment of the lid and the closing mechanism via the locking parts C, D is that easy opening of the lids can be carried out only by means of a certain opening procedure.

By applying pressure, for example an index finger pushes on the approximate center of the curvature of the elastic lid the same is pushed slightly inward. In this manner the closing part D is lifted, whereby both latching lips begin to glide apart.

A user desired simultaneous lifting of the selected lid on the closing side is easily possible in this phase.

The described closing construction is therefore created in that an unintentional opening is avoided. The closing elements assume a position which enables the slight lifting of the lid from the opening side only via the finger pressure on the desired lid by means of flattening of the lid's curvature.

Further details, features, and advantages of the invention are obvious from the following description of an exemplary embodiment with reference to the related drawings.

Figure 4:
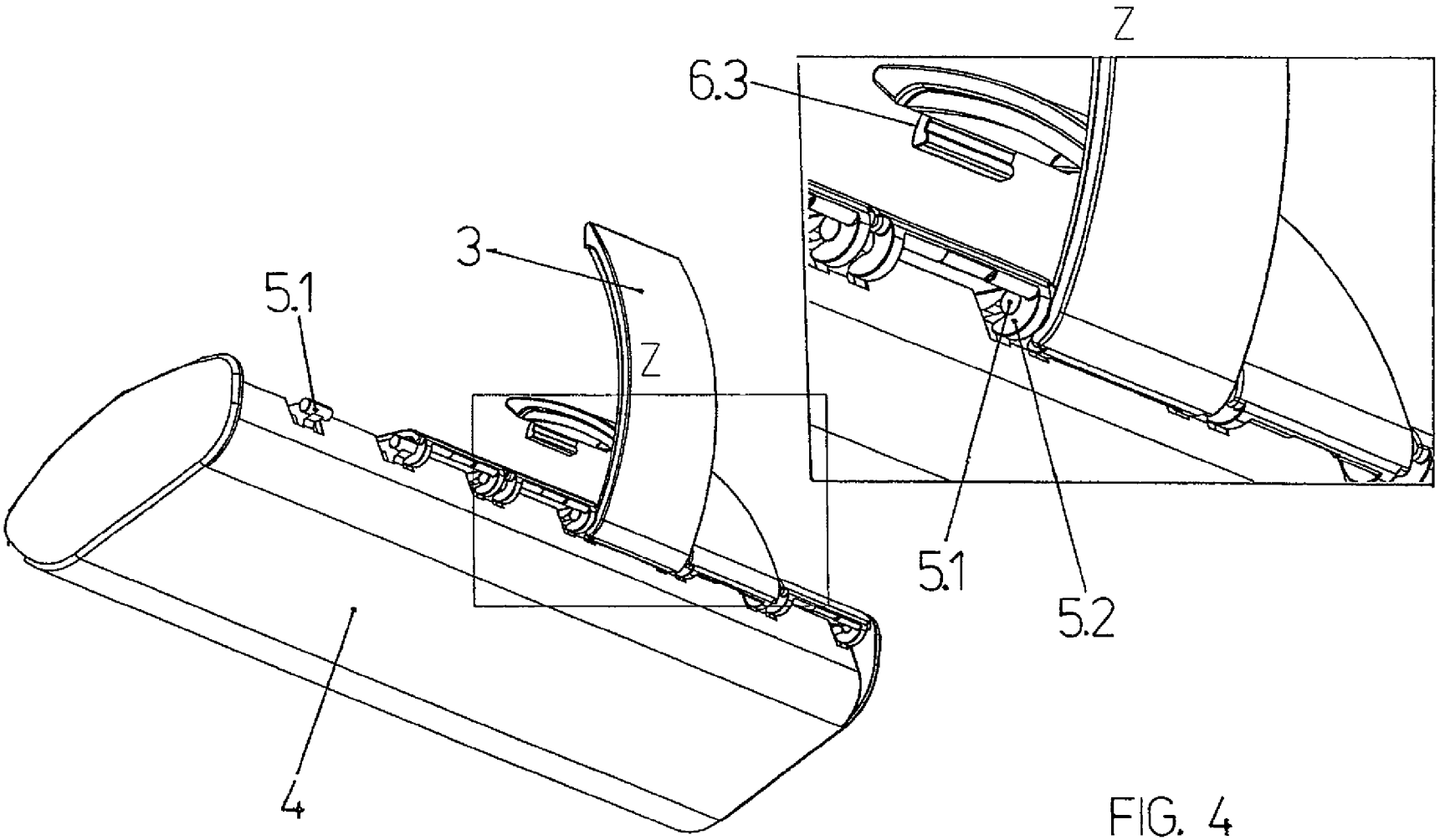
Figure 5:
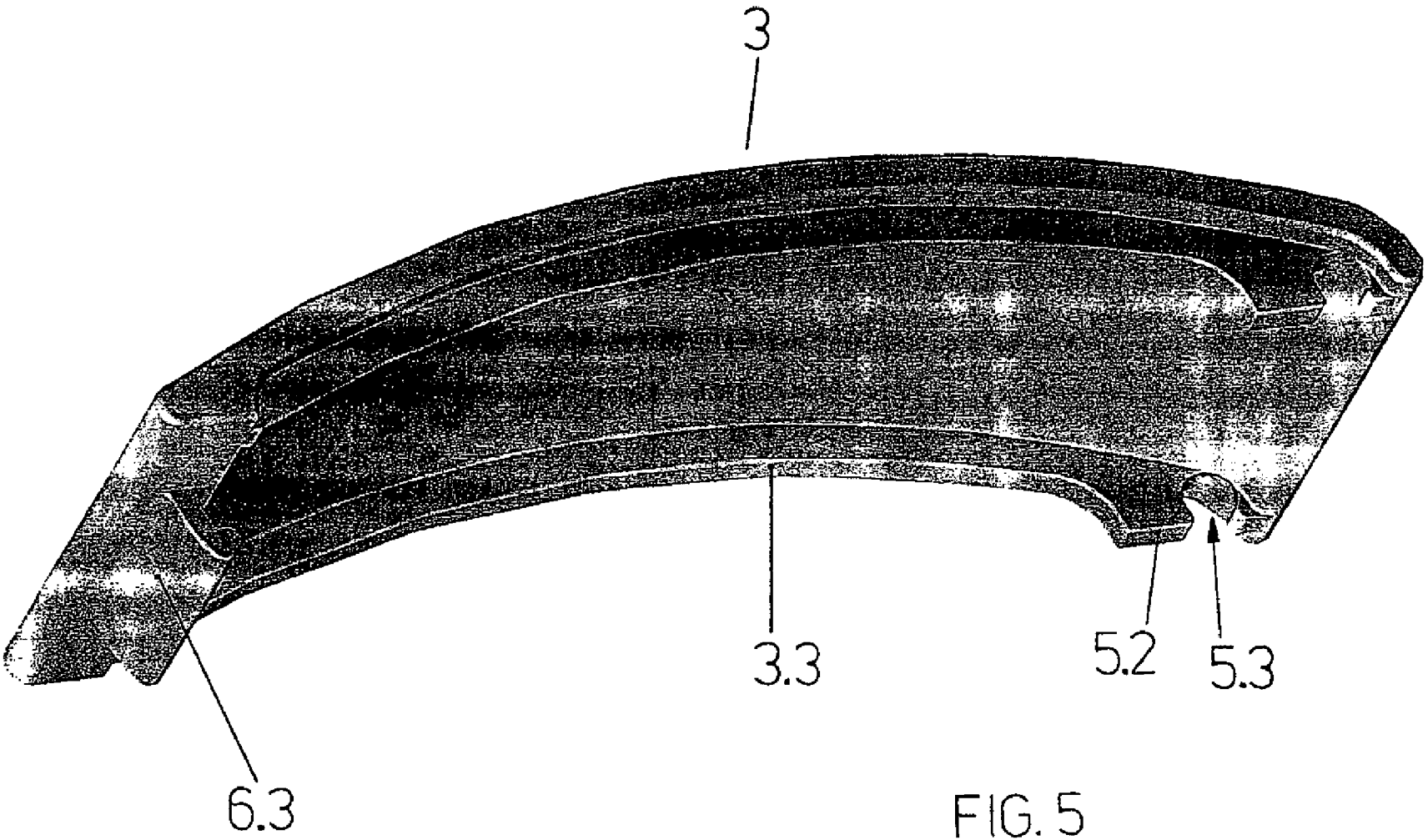

They show:

FIG. 1 a perspective illustration of an embodiment of the novel weekly dispenser, wherein the first three lids are open;

FIG. 2 various views of the bottom part of the weekly dispenser, more specifically in FIG. 2.1 a perspective view, in FIG. 2.2 the top view, and in FIG. 2.3 the side view;

FIG. 3 three views of a lid having a first embodiment of the hinge claws, wherein FIG. 3.1 shows a perspective view, FIG. 3.2 shows the side view, and FIG. 3.3 shows the front view;

FIG. 4 a perspective illustration of a hinge construction in the installed state;

FIG. 5 a perspective overall view of a lid, wherein the hinge claws are embodied according to the $2^{nd}$ embodiment.

FIG. 1 shows an exemplary embodiment of the weekly dispenser according to the invention. The bottom part 4 comprised of seven individually accessible compartments 1 (also compare to FIG. 2) has six internal partitions 2.1 for configuring same sized compartments 1 comprising a rectangular shape, and two face walls 2.2 positioned on the outside. The upper edge 2.3 of all partitions 2 is configured with a curvature at a radius of R=46 mm at the longitudinal extension thereof. The wall 4.3 is arched toward the outside on the access side of the bottom part 4 in order to facilitate the grasping of tablets or the like from the respective compartment 1, also compare to FIG. 2.

The lids 3 have an adjusted curvature R', and do not rest on the internal partitions 2.1, or on the offset 2.4 on the interior of the face walls 2.2 in the closed state.

In order to mount and lock the lids 3 the associated hinge parts 5 and locking parts 6.1 to 6.4 are disposed on the lateral edges 3.2 of the lids 3 and on the two longitudinal sides 4.1, 4.2 of the bottom part 4, also see FIG. 2, in the area of the seven compartments 1.

Supplementally, FIG. 2 shows the construction of the hinge parts 5.1 on the base part 4, and FIG. 3 and FIG. 5 show the construction of the hinge and locking parts on the lid 3.

The pins 5.1 (hinge parts A) positioned on the hinge and longitudinal side 4.1 of the bottom part 4 outside of the compartments 1 are disposed in pairs on the internal partitions 2.1 that are extended beyond the compartments 1, and on the interior of the face walls 2.2 in a simple embodiment.

The locking parts C located on the opposite longitudinal side 4.2 of the bottom part 4 are comprised of recesses 6.1 having a latching lip 6.2 (see FIG. 1) positioned on the top, which are inserted in the center in the upper edge region of the compartments.

FIG. 3 and FIG. 5 show the locking parts D on the lids 3, more specifically the latching bar 6.3 and the latching lip 6.4 in the same embodiment.

The hinge parts B are embodied differently in FIGS. 3 and 5.

In a first embodiment shown in FIG. 3 two claws 5.2 are present at the lateral edge 3.2 of the lid 3, which are placed at a distance to the longitudinal edges 3.1 of the lid by approximately half the thickness of the internal partitions 2.1. Said claws 5.2 extend as an elongation of the respective rib reinforcement 3.3. At a circumferential angle of approximately 220° the claws 5.2 comprise the associated pins 5.1 of the hinge parts A located on the bottom part. Via the claw opening 5.3, which is significantly smaller than the diameter of the pins 5.2, the claws 5.2 are slid on tightly onto the pins 5.1 during the installation of the lids 3 on the bottom part 4.

In the second embodiment of the claws 5.2 according to FIG. 5 the claw 5.2 and the claw opening 5.3 are inserted into their rib reinforcement 3.3 that is enlarged corresponding to the depth thereof.

FIG. 4 shows the hinge parts A and B described in FIG. 1 to FIG. 3 in the mounted state.

Materials suitable for the parts of the weekly dispenser are, for example: acrylic butadiene styrene (ABS) for the bottom part, and polycarbonate (PC) for the lids.

List of Reference Symbols

1 medicament compartments, compartments
- 2 partitions
  - 2.1 internal partitions
  - 2.2 front walls
  - 2.3 upper edge
  - 2.4 offset on the interior of front wall
- 3 lids
  - 3.1 longitudinal edges
  - 3.2 lateral edges
  - 3.3 rib reinforcement
- 4 bottom part
  - 4.1 longitudinal side—hinge
  - 4.2 longitudinal side—lock/access
  - 4.3 wail arched toward the outside—on the access side
- 5 hinge parts
  - 5.1 pin, hinge part A
  - 5.2 claw, hinge parts B
  - 5.3 claw opening, hinge parts B
- 6 locking parts
  - 6.1 recess (locking parts C)
  - 6.2 latching lip (locking parts C)
  - 6.3 latching bar (locking parts D)
  - 6.4 latching lip (locking parts D)

The invention claimed is:

1. A weekly dispenser for medicaments comprising a rectangular bottom part with seven compartments that are separated by partitions, seven independent, dimensionally stable and elastic lids, each of the seven independent, dimensionally stable and elastic lids being pivotably connected by an associated hinge part to a respective one of the seven compartments such that each compartment can be individually accessed, and locking parts for locking each of the seven independent, dimensionally stable and elastic lids in a closed position to a respective one of the seven compartments, wherein the seven compartments in the bottom part of the weekly dispenser are embodied with a same-sized rectangular horizontal section, at least one longitudinal side of the bottom part forming the access side has a wall arched toward the exterior, top edges of all partitions have a uniform curvature having a radius R in the longitudinal extension thereof, the seven independent, dimensionally stable and elastic lids covering and locking the seven compartments have a curvature R' adapted to correspond to the uniform curvature having the radius R of the top edge of the partitions, longitudinal edges of the seven independent, dimensionally stable and elastic lids extending parallel to the partitions overlap the internal partitions by approximately half without resting on the same in the locked state, and the associated hinge parts and the locking parts are disposed on the narrow lateral edges of the lids and on or along the two longitudinal sides of the bottom part in the area of the seven compartments for mounting and locking the seven independent, dimensionally stable and elastic lids, wherein upon the application of pressure onto a central or rear region of one of the seven independent, dimensionally stable and elastic lids, the locking parts for the one of the seven independent, dimensionally stable and elastic lids start detaching from one another.

2. The weekly dispenser according to claim 1, wherein the curvature radius R of the top edge of all partitions is approximately 45 to 55 mm.

3. The weekly dispenser according to claim 1, wherein the hinge parts are positioned on one longitudinal side of the bottom part outside of the compartments and are comprised of two horizontal pins disposed in an intended straight parallel to the longitudinal sides of the bottom part, which engage in pairs on both sides of the internal partitions extended beyond the compartments in the top region of the partitions, and individually on the projecting interiors of both front walls of the bottom part.

4. The weekly dispenser according to claim 1, wherein the locking parts are incorporated in the center in the top edge region for each compartment as recesses inserted from the exterior, having a latching lip positioned on top.

5. The weekly dispenser according to claim 1, wherein the seven independent, dimensionally stable and elastic lids have a rectangular horizontal section, and comprise the parts and the locking parts on opposite lateral edges.

6. The weekly dispenser according to claim 1, wherein the hinge parts are comprised of two claws per lid, which are integrally molded onto the narrow side of the lid edge on the lateral edge, wherein said claws are positioned at a distance to the longitudinal edges of the lid by approximately half of the thickness of the internal partitions, and comprise the associated pins of the hinge parts at a circumferential angle of approximately 200 to 220°.

7. The weekly dispenser according to claim 6, wherein a rib reinforcement having a consistent cross-section that is quasi interrupted for configuring the claw opening and at the same thickness of the claws is provided as an extension on the bottom side and parallel to the longitudinal edges of the lids, wherein the end of the rib reinforcement on the claw side forms the inner side of the claw opening facing the lid bottom.

8. The weekly dispenser according to claim 7, wherein the rib reinforcement of the hinge part also has a consistent width, the depth thereof is extended in the hinge region such that the required embodiment of the claw and the claw opening may be carried out at a sector angle of approximately 140 to 160° for sliding on the associated pin of the hinge part.

9. The weekly dispenser according to claim 5, wherein the locking parts disposed on the side of the lids opposite of the hinge parts are comprised of a latching bar having a latching lip provided on the end of the bar and positioned on the interior.

* * * * *